US008104656B1

(12) United States Patent
George

(10) Patent No.: US 8,104,656 B1
(45) Date of Patent: Jan. 31, 2012

(54) SPARE AMMUNITION MAGAZINE CARRIER WITH PIVOTABLE FLAP

(75) Inventor: Daniel F. George, Sutton, MA (US)

(73) Assignee: Daniel F. George, Sutton, MA (US)

( * ) Notice: Subject to any disclaimer, the term of this patent is extended or adjusted under 35 U.S.C. 154(b) by 0 days.

(21) Appl. No.: 13/050,642

(22) Filed: Mar. 17, 2011

Related U.S. Application Data

(63) Continuation of application No. 10/876,266, filed on Jun. 23, 2004, now abandoned.

(60) Provisional application No. 60/480,265, filed on Jun. 23, 2003.

(51) Int. Cl.
*A45F 5/00* (2006.01)
*F42B 39/00* (2006.01)

(52) U.S. Cl. ..... 224/674; 224/684; 224/239; 224/241; 224/931

(58) Field of Classification Search ..... 224/196, 224/199, 654, 684, 678, 235, 236, 931, 914, 224/241, 674, 239; 220/524, 840
See application file for complete search history.

(56) References Cited

U.S. PATENT DOCUMENTS

| | | | | |
|---|---|---|---|---|
| 1,175,907 | A * | 3/1916 | Slade | 221/185 |
| 2,585,592 | A * | 2/1952 | Sears | 224/197 |
| 3,688,953 | A * | 9/1972 | Bianchi et al. | 224/192 |
| 5,174,482 | A * | 12/1992 | Rogers et al. | 224/239 |
| 5,501,381 | A * | 3/1996 | Rogers et al. | 224/243 |
| 6,202,908 | B1 * | 3/2001 | Groover | 224/239 |

* cited by examiner

*Primary Examiner* — Justin Larson
(74) *Attorney, Agent, or Firm* — Gerry Blodgett

(57) ABSTRACT

Disclosed herein is a spare magazine carrier for securing at least one magazine on a user's belt. The carrier includes at least one pocket for receiving the magazine and a pivotal cover atop the pocket for retaining the magazine therein. The cover normally extends over the top of the pocket and prevents withdrawal of the magazine and can be rotated to the side of the pocket to allow withdrawal of the magazine from the pocket. The cover is pivotally attached to the pocket with a frictional hinge in order to prevent inadvertent cover movement and thus inadvertent magazine removal.

5 Claims, 7 Drawing Sheets

SPARE AMMUNITION MAGAZINE CARRIER WITH PIVOTABLE FLAP

CROSS-REFERENCE TO RELATED APPLICATIONS

This application is a continuation of U.S. non-provisional application Ser. No. 10/876,266 filed Jun. 23, 2004, now abandoned, which claims the benefit under 35 U.S.C. section 119(e) of U.S. provisional application No. 60/480,265 filed Jun. 23, 2003 which is hereby incorporated by reference.

STATEMENT REGARDING FEDERALLY SPONSORED RESEARCH OR DEVELOPMENT

This invention has been created without the sponsorship or funding of any federally sponsored research or development program.

REFERENCE TO SEQUENCE LISTING, A TABLE, OR A COMPUTER PROGRAM LISTING COMPACT DISK APPENDIX

Not applicable

BACKGROUND OF THE INVENTION

The field of the invention generally pertains to ammunition magazine holders and carriers. The invention relates more particularly to a spare magazine carrier for securing ammunition-magazines on a user's person by means of a flap capable of retracting pivoting down and away from a pocket opening when released from a secured position. In this manner, the user can quickly, easily, and unobstructedly access one or more ammunition magazines seated therein for rapid reloading of a firearm.

The ammunition magazine, pre-loaded with multiple ammunition cartridges, was a key development in the evolution of 20th Century small arms weaponry. With it came the corresponding need to carry extra ammunition magazines in order to reload a firearm. Consequently, various magazine holders and carriers mounted on the user's person were developed to provide a convenient means for transporting and making available one or more spare ammunition magazines. Magazine carriers function to secure magazines in their place and protect them against damage, malfunction, and/or loss, especially during the rigorous conditions commonly encountered in combat by law enforcement and military personnel.

Moreover, because spare magazines are oftentimes utilized during extreme life-threatening combat situations, magazine carriers must allow rapid and easy access to a full magazine for reloading and must allow resuming fire with minimal delay. In particular, it is often critical for magazine carriers to enable the release, access, and acquisition of a spare magazine with the non-firing free hand, while maintaining a grip on the firearm with the firing hand. For this reason, magazine carriers are typically mounted or fastened on a belt, vest, or other garment worn by the user, where it is within easy reach of the user's free hand. Failure to quickly reload a full magazine while engaged in a gun battle can mean serious injury, capture, and/or death.

One common example of a spare magazine carrier incorporates a top flap which folds down and over an exposed upper portion of a magazine seated within a pouch, much like a button down shirt pocket. Typically, the top flap has one end attached to the back of a pocket or pouch, and a free end which folds down and over a seated magazine and fastens to a front side of the pouch by a detachable snap fastener. The snap fastener has a male (or female) portion on the free end of the top flap, and a corresponding female (or male) portion attached to the front side of the pouch.

Perhaps the greatest problem with the top flap magazine carrier, however, is the numerous movements required to access a spare magazine contained therein. Typically this requires five distinct movements which must be independently executed by the non-firing free hand. First, the user must unfasten the flap from the front portion of the pouch. Second, the user must then raise the flap up to clear the exit path. Third, the user must hold the flap up and out of the way. Fourth, the user then grasps the magazine. And finally, the user withdraws the magazine from the carrier and commences reloading of the firearm. While this design provides sufficient security against loss, it can effectively hinder the rapid access and deployment of magazines for quick reloading of a weapon. Moreover, in addition to the delay caused by the number of movements involved, the interfering presence of the flap in the exit path of the magazine in steps three and four can also sufficiently hinder access to the magazine which can cause mishandling and loss of the magazine.

Additionally, in U.S. Pat. No. 5,617,582, a load bearing vest is shown having pouches 140 with corresponding flaps 148 which utilize a drawstring 162 to lift and hold the flaps up and away from the pouch while accessing an ammunition magazine seated in the pouch. The problem with this design, however, is that while it eliminates step three in the five step procedure discussed above, the operation of the pouch still requires lifting of the flap, i.e. step two above, by pulling the drawstring. Further, and perhaps more importantly, the flap still obstructs access to the magazine because it is still essentially a top flap magazine carrier as described above. Consequently, even when pulled open using a drawstring 162, the flap still remains in the exit path of the spare magazine. Under high stress and demanding situations common during combat, the presence of even a fully retracted flap may interfere and hinder the deployment of the fresh magazine, and thereby jeopardize the safety of the user.

In a third common magazine carrier design disclosed in U.S. Pat. No. 5,484,093, the top flap is eliminated altogether which obviates the obstruction problem caused by a top flap, and thus facilitates speedy access. The magazine pouch in the 093 patent utilizes a tensioning bolt 22 to friction fit a spare magazine in a main body portion 10. However, retention of magazines by friction fit can be unreliable, especially in rigorous combat situations. Intense physical movement and activity during combat can cause dislodging and loss of the magazine, which would otherwise have been retained by a protective flap or other catch mechanism. In this arrangement, therefore, security is sacrificed for speed and the magazine is always susceptible to damage or loss.

In a fourth magazine carrier design disclosed in U.S. Pat. No. 6,202,908, the top flap is releasably fastened at its end to the back of the magazine holder, but elastically bias downward and out of the way of the opening. In this way, when the end of the flap is released, the flap spontaneously slips out of the way. However, the elastic material used to cause the biasing is not as durable as the other material from which the magazine carries are constructed. As the elastic material age, they become less reliable. Furthermore, in order to control the path of the released flap, a band is placed around the flap. This can bind the flap and interfere with its retraction, especially because the band is positioned so the it can accumulate dirt and debris under combat conditions and that will interfere with the retraction.

These and other difficulties experienced with the prior art devices have been obviated in a novel manner by the present invention.

In summary, there is a need for a spare magazine carrier mountable on a user's person which is capable of securely retaining at least one spare ammunition magazine, and providing simple, immediate, and unobstructed access to the at least one spare ammunition magazine when needed. In particular, while a flap is preferably used to properly retain a spare magazine, it would be advantageous to remove the flap completely away from an access/exit path of the spare magazine when access is desired.

It is an object of the present invention to provide a simple, durable, and reliable spare magazine carrier mountable on a user's person, which is capable of securely retaining one or more spare ammunition magazines in the carrier, and providing convenient, immediate, and unobstructed access to the one or more spare ammunition magazines when desired or needed.

It is a further object of the present invention to provide a simple, durable, and reliable spare magazine carrier mountable on a user's person, for protectively covering one or more spare ammunition magazines to prevent damage, malfunction and/or loss of the magazines prior to use.

It is a still further object of the present invention to provide a spare magazine carrier which is simply and conveniently mountable anywhere on a user's person within easy reach of the user.

It is a further object of the invention to provide an ammunition magazine carrier which is capable of being manufactured of high quality and at a low cost, and which is capable of providing a long and useful life with a minimum of maintenance.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

The present invention is for a spare magazine carrier securable on a user's person for carrying at least one ammunition magazine. In a preferred embodiment, the spare magazine carrier has a carrier frame including a base wall with a top end and a bottom end, pocket means connected to the base wall for seating at least one ammunition magazine against the base wall through at least one pocket opening, and means for mounting the carrier frame to the user's person. Additionally, the spare magazine carrier has at least one flap member with a first flap end, an second flap end, said first flap end being pivotally mounted adjacent one side of the pocket opening and said second flap and being pivotally mounted to a second side of the pocket opening opposite the first side of the pocket opening, so that the flap can be pivoted from a closed position which covers and obstructs the pocket opening and protects and locks a magazine in the pocket, to an open position which does not cover and does not obstruct the pocket opening and allows a magazine to be inserted into or remove from the pocket. The pivotal fastening means that attaches each flap end of the flap to the pocket may allow detachment so that the flap can be completely removed from the pocket. The pivotal fastening means may include friction enhancement means that provides resistance to the pivotal action as the flap is moved from the closed position to the open position and back, thereby allowing the flap to maintain a selected position throughout the range of its movement. The pivotal fastening means may also include locking means that reversibly lock the flap in a selected position such as the closed position or the open position.

BRIEF DESCRIPTION OF THE SEVERAL VIEWS OF THE DRAWING

The character of the invention, however, may best be understood by reference to one of its structural forms, as illustrated by the accompanying drawings, in which.

DETAILED DESCRIPTION OF THE INVENTION

Figure 1:
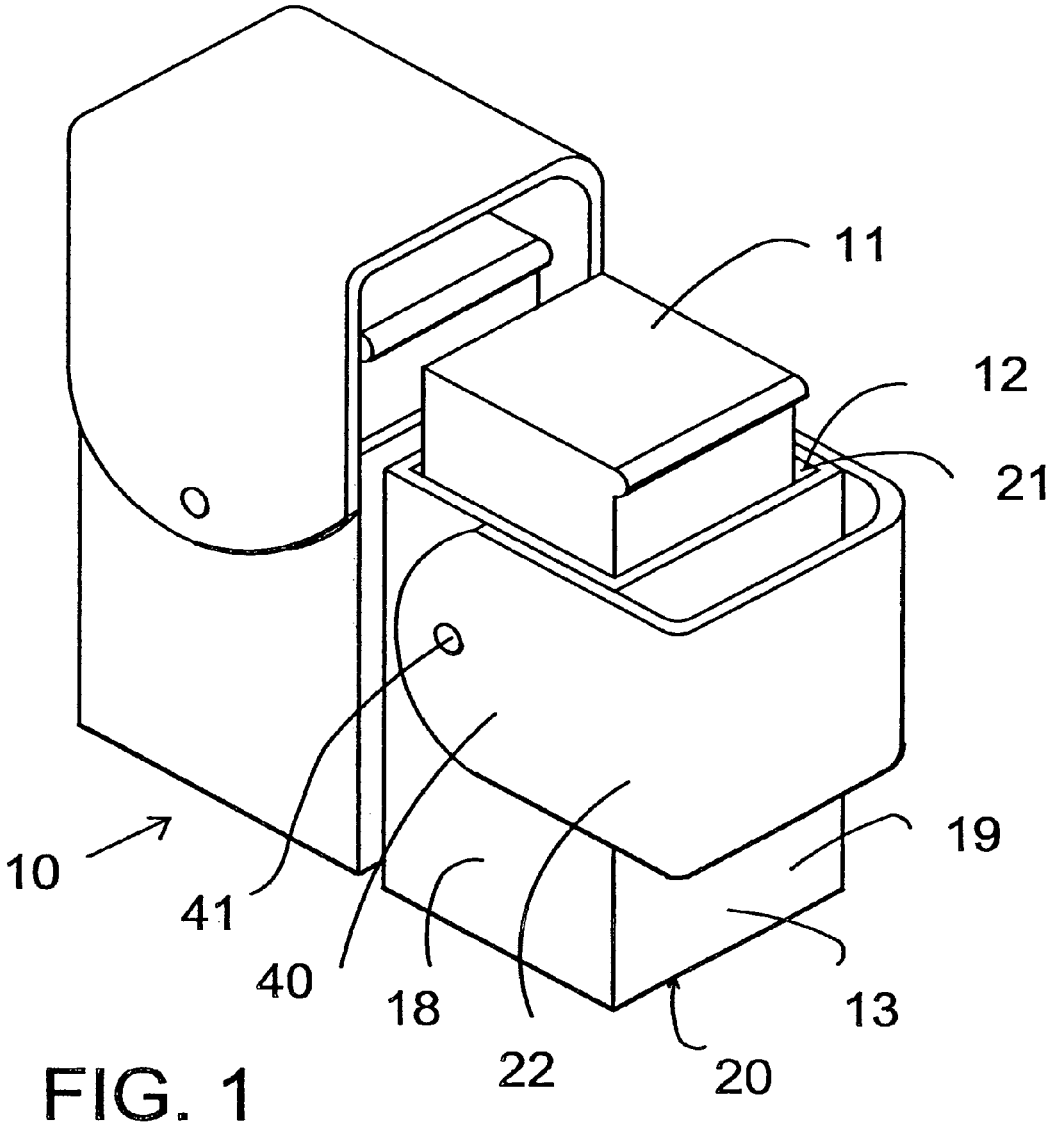
FIG. 1 is a perspective view of an ammunition magazine carrier embodying the principles of the present invention, and shown with one flap in a closed position, and one flap in an open position.

Referring now to the drawings, FIG. 1 shows a spare magazine carrier, generally indicated at reference character 10, for securing a spare ammunition magazine 11 on a user's person. The spare magazine carrier 10 generally has two main components: namely, a carrier frame, generally indicated at reference character 13, and a flap member, generally indicated at reference character 22. The carrier frame 13 generally functions as the platform of the magazine carrier 10 for seating a spare magazine 11 against the user's person, while the flap member 22 generally functions to securely retain the magazine 11 in the carrier frame 13.

As can be seen in FIG. 1, showing a first preferred embodiment of the magazine carrier 10, the carrier frame 13 has at least one pocket 12 with at least one pocket opening 21 for receiving a magazine 11 therein. FIG. 1 shows an exemplary dual-pocket embodiment, although embodiments with a single pocket are also contemplated by the invention. Likewise, the magazine carrier 10 can also be embodied having multiple pockets over and beyond two pockets, for seating a plurality of magazines 11.

The carrier frame 13 of the preferred embodiment comprises a base wall 14 (not shown in FIG. 1, but shown in FIG. 4), a bottom wall 20, a front wall 18, and side walls 19 and 26 (not shown in FIG. 1, but shown in FIG. 2) connecting the front wall 18 to the base wall 14, thereby forming and defining the at least one pocket 12 with at least one pocket opening 21. The base wall 14, front wall 18, side walls 19 and 26, and bottom wall 20 together provide lateral and subjacent support for a seated magazine 11. The base wall 14 has a generally flat shape with a top end 15 and a bottom end 16 (shown in FIG. 3). One side of the base wall 14 abuts against the user's person (not shown), and the opposite side contactedly faces a seated magazine 11.

The front wall 18 and side walls 19 and 26 can have a low or high cut, wherein more or less, respectively, of the seated magazine 11 is exposed when seated in the carrier frame. It is notable, that a low cut carrier has a speed and convenience advantage over a high cut carrier by allowing the ammunition magazine 11 to be more easily grasped and withdrawn.

Figure 3:
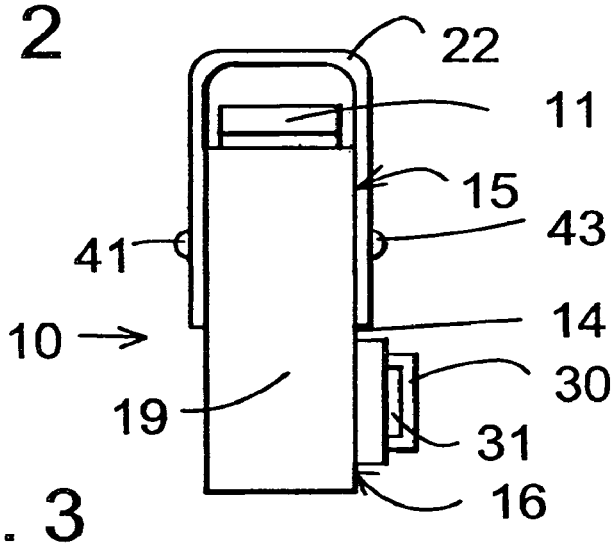
FIG. 3 is a right side elevation view of the ammunition magazine carrier as shown in FIG. 2.
Figure 4:
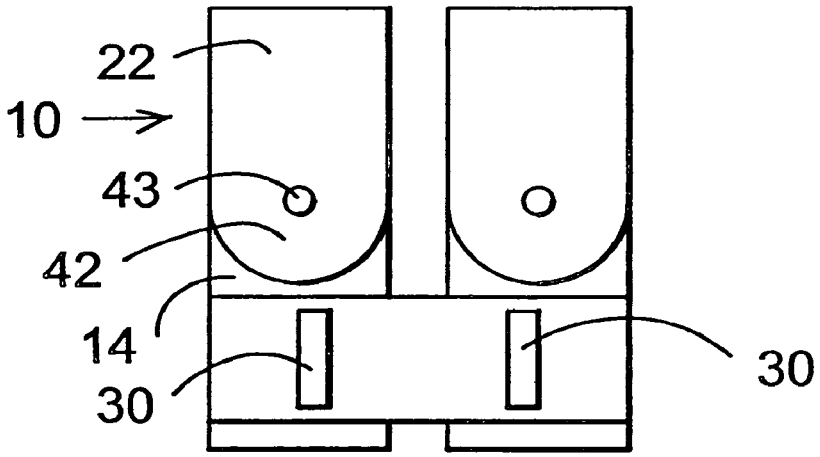
FIG. 4 is a rear elevation view of the magazine carrier as shown in FIG. 2.

The carrier frame 13 is mountable on the user's person at a conveniently accessible location, such as on a belt, vest, harness, or other garment worn by the user. As can be seen in FIGS. 3 and 4, the means for mounting the carrier frame 13 may be at least one belt loop 30 connected to the base wall 14, and defining a loop channel 31. The belt loop(s) 30 may be integrally formed or affixed on the base wall 14. In any case, the magazine carrier 10 is mounted on the user's person by sliding a belt worn by the user (not shown) through the loop channel 31.

Construction of the carrier frame 13 can be made of any light weight rigid material. It can be made from natural materials such as leather, or synthetic materials such as the polycarbonate material sold under the trademark "Kydex." It is notable that "Kydex" retains it shape and resiliency particularly well against heat, moisture, wear, and body chemicals, is economical to produce, and has less bulk and weighs less than leather, and is therefore a preferred material for the carrier frame 13. It is notable that the carrier frame 13 would function equally as well if constructed entirely of a non-rigid material or fabric. As can be seen in FIG. 1, the flap member 22 has a first end 40 that is pivotally mounted, by pivotal mounting 41, such as a snap fastener, to the front surface of the front wall 18, adjacent the pocket opening 21. As can be seen in FIG. 4, the flap member 22 has a second end 42 that is pivotally mounted, by pivotal mounting 43, such as a snap fastener, to the rear surface of the base wall 14, adjacent the pocket opening 21 (not shown in FIG. 4, but shown in FIG. 7). The axis of rotation of the pivotal mounting 41 and the pivotal mounting 43 are coaxial so that the flap member 22, can move from an closed position in which the flap member 22 extends over the upper portion 39 of the seated magazine 11, and across the opening 21 of the pocket 12, to an open position in which the flap member 22 does not extend over the upper portion 39 of the seated magazine 11 and is not across the opening 21 of the pocket 12, thereby allowing the magazine 11 to be easily inserted into and removed from the pocket 12.

Figure 2:
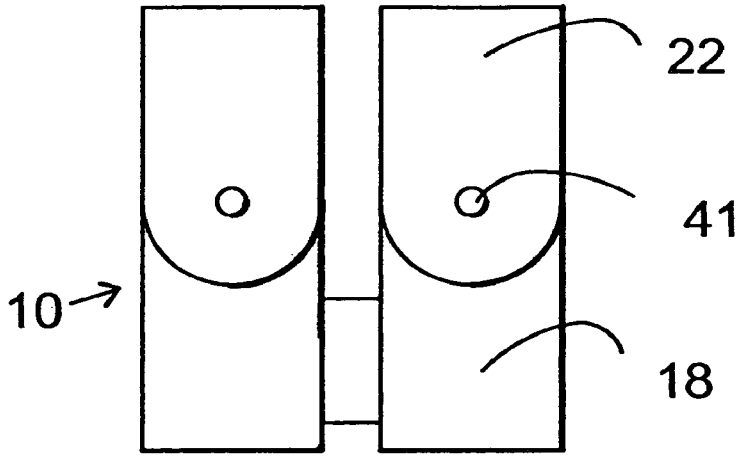
FIG. 2 is a front elevation view of an ammunition magazine carrier embodying the principles of the present invention, and shown in a closed position.

The release operation of the flap member 22 to provide an unobstructed exit path for the seated magazine 11 is shown in more detail in FIGS. 2-13. In FIGS. 2-4, the magazine carrier 10 is shown in the closed position with the flap 22 above the magazine 11 and obstructing the removal of the magazine from the pocket 12. FIG. 2 is a front view, FIG. 3 is a right side view, and FIG. 4 is a rear view. The flap 22 is pivotally and removably connected to the front wall 18 by means of snap connector 41, and to the base wall 14 by means of snap connector 43. The inverted U-shaped configuration of the flap 22, as shown in FIG. 3, provides a smooth profile.

Figure 5:
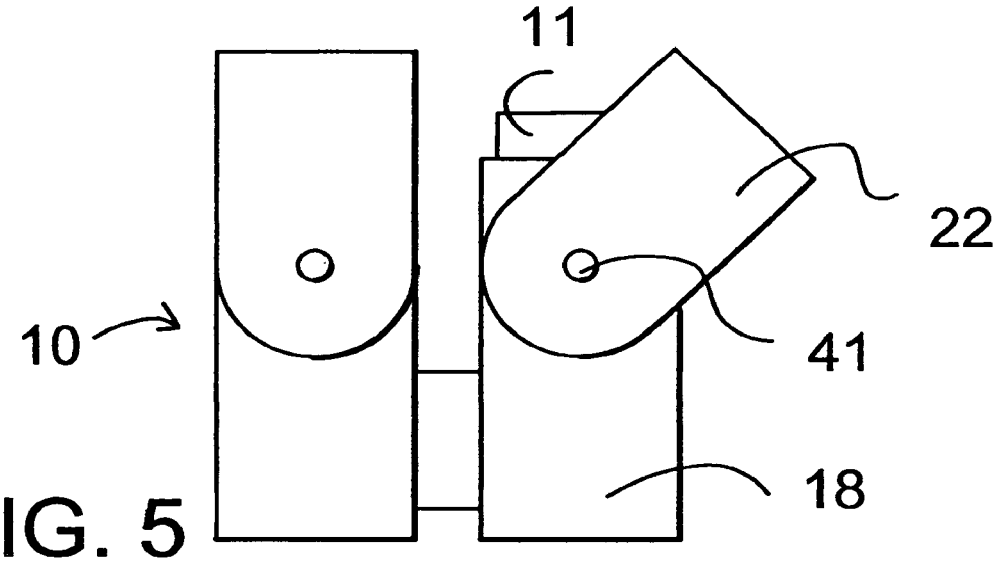
FIG. 5 is a front elevation view of the ammunition magazine carrier shown in FIG. 2, and but in an intermediate position.
Figure 6:
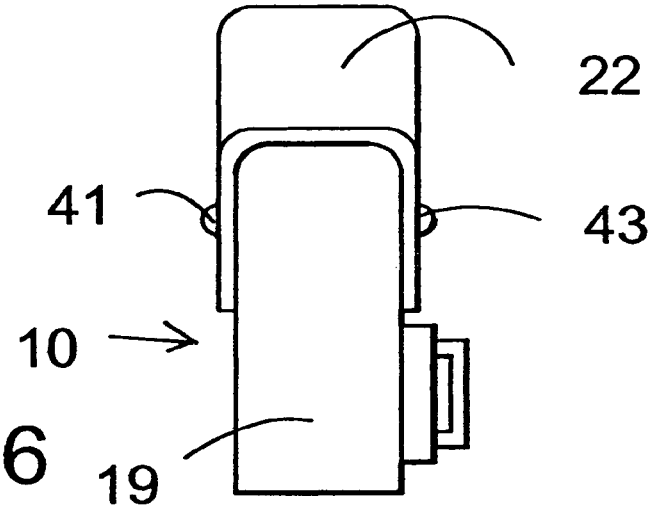
FIG. 6 is a right side elevation view of the ammunition magazine carrier as shown in FIG. 5.
Figure 7:
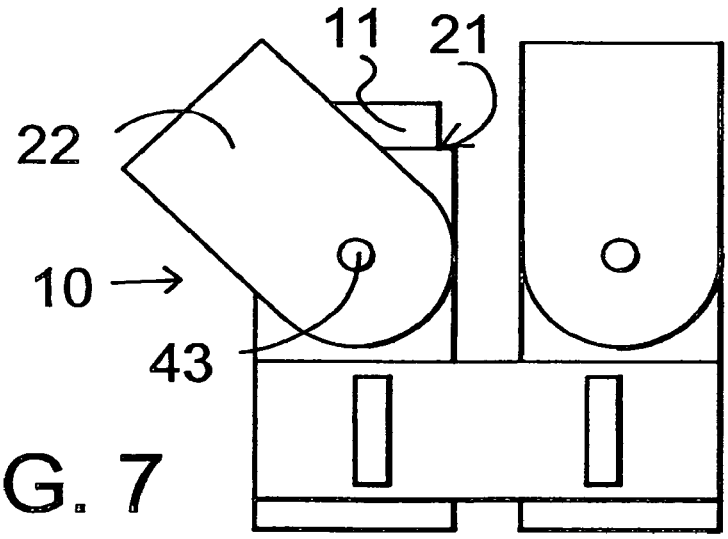
FIG. 7 is a rear elevation view of the magazine carrier as shown in FIG. 5.

In FIGS. 5-7, the magazine carrier 10 is shown in an intermediate position after the flap 22 was pivoted from the closed position to the intermediate position, with the flap 22 above and to the side of the magazine 11 and partially obstructing the removal of the magazine from the pocket 12. FIG. 5 is a front view, FIG. 6 is a right side view, and FIG. 7 is a rear view.

Figure 8:
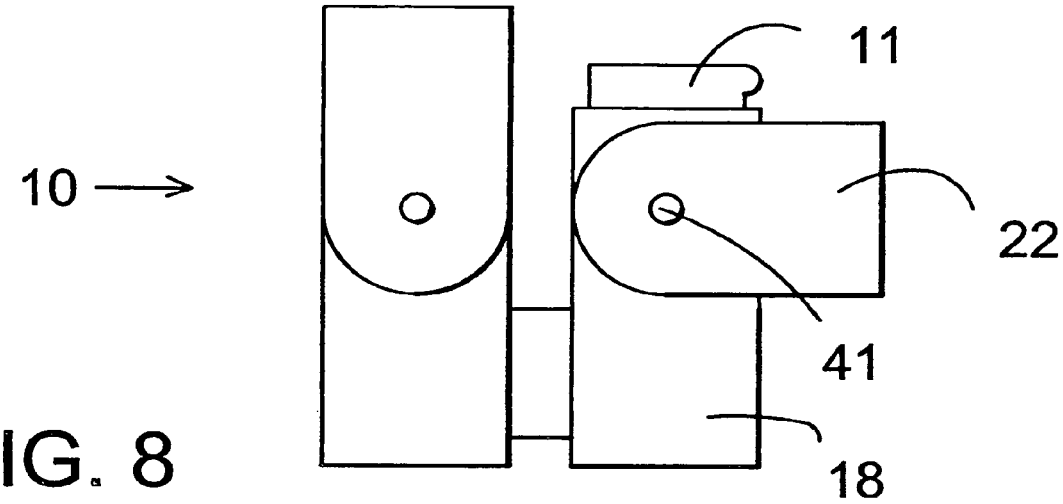
FIG. 8 is a front elevation view of the ammunition magazine carrier shown in FIG. 2 and but in an open position.
Figure 9:
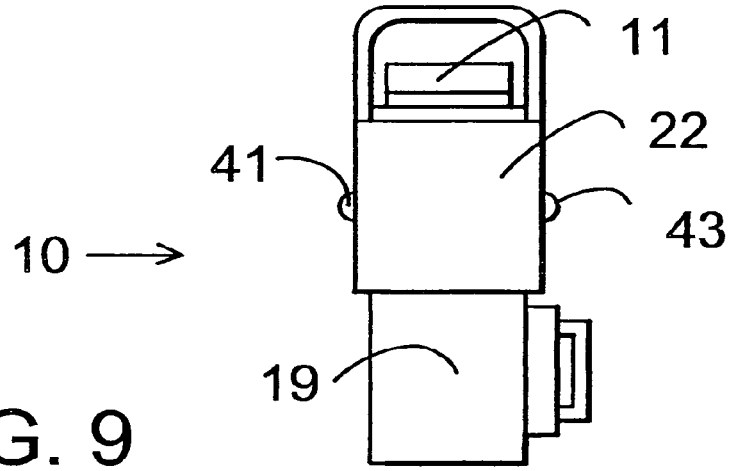
FIG. 9 is a right side elevation view of the ammunition magazine carrier as shown in FIG. 8.
Figure 10:
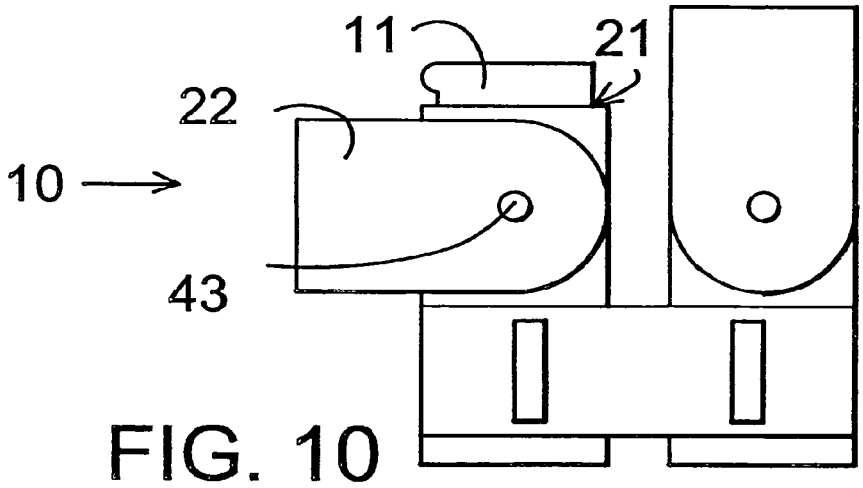
FIG. 10 is a rear elevation view of the magazine carrier as shown in FIG. 8.
Figure 11:
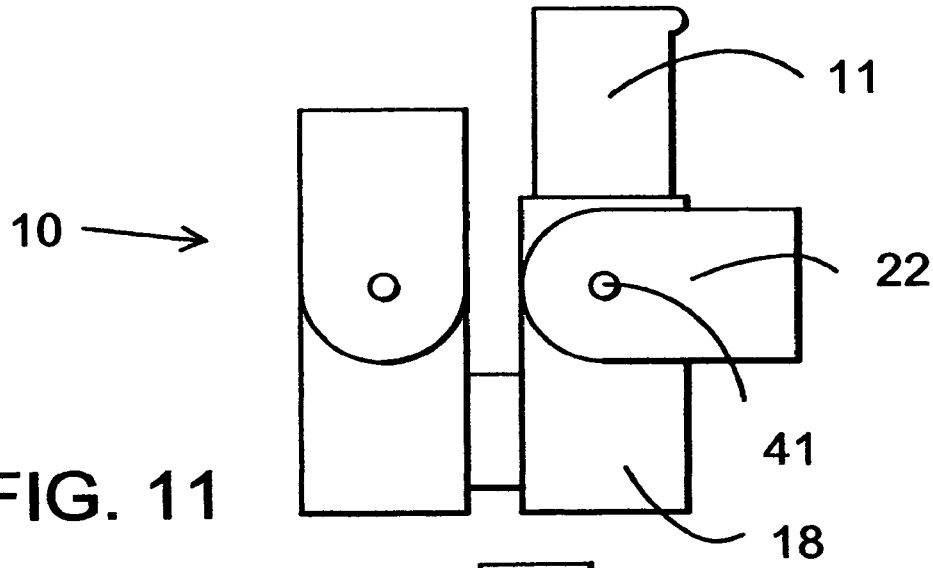
FIG. 11 is a front elevation view of the ammunition magazine carrier shown in FIG. 2, and but in an open position with the magazine being extracted.
Figure 12:
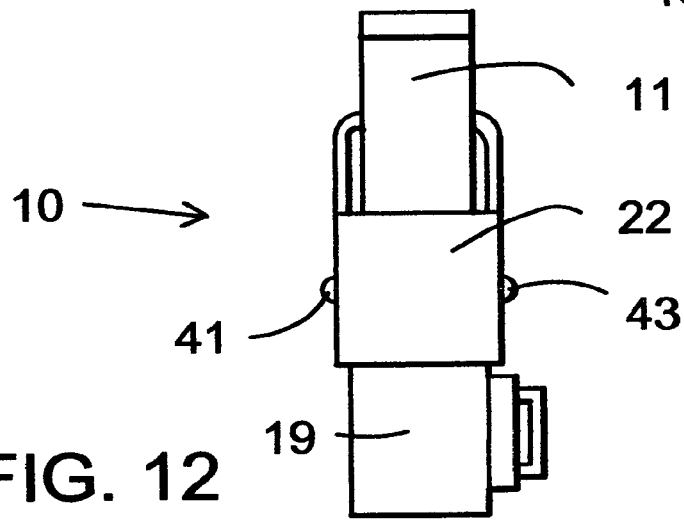
FIG. 12 is a right side elevation view of the ammunition magazine carrier as shown in FIG. 11.
Figure 13:
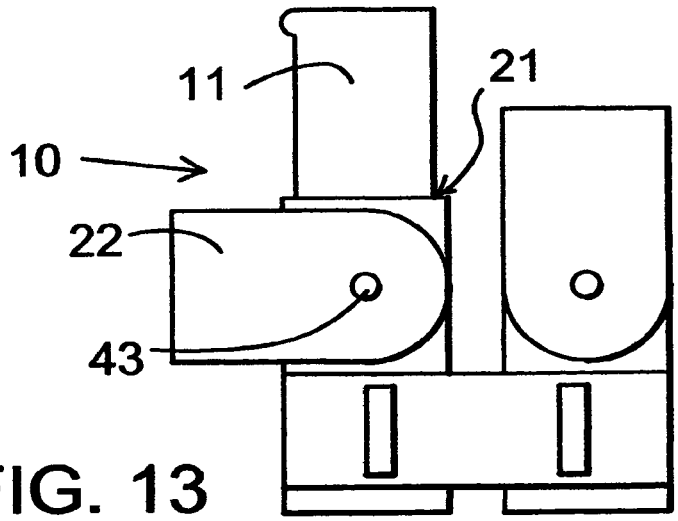
FIG. 13 is a rear elevation view of the magazine carrier as shown in FIG. 11.

In FIGS. 8-10, the magazine carrier 10 is shown in an open position after the flap 22 was pivoted from the closed position to the open position, with the flap 22 to the side of the magazine 11 and not obstructing the removal of the magazine from the pocket 12. FIG. 8 is a front view, FIG. 9 is a right side view, and FIG. 10 is a rear view. In FIGS. 11-13, the magazine carrier 10 is shown in an open position after the flap 22 was pivoted from the closed position to the open position, with the flap 22 to the side of the magazine 11 and not obstructing the removal of the magazine from the pocket 12. The magazine 11 is shown partially extracted from the pocket 12. FIG. 11 is a front view, FIG. 12 is a right side view, and FIG. 13 is a rear view.

Figure 14:
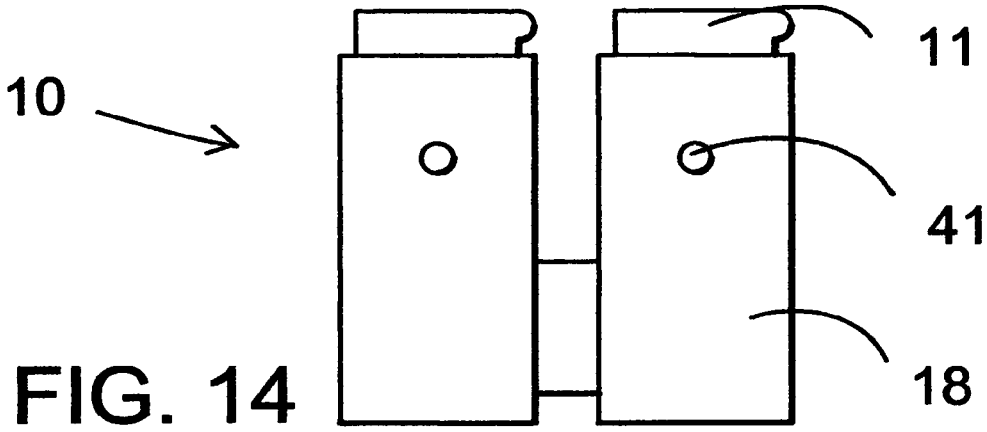
FIG. 14 is a front elevation view of the ammunition magazine carrier shown in FIG. 1, and but in an open position with the flap removed from the carrier.
Figure 15:
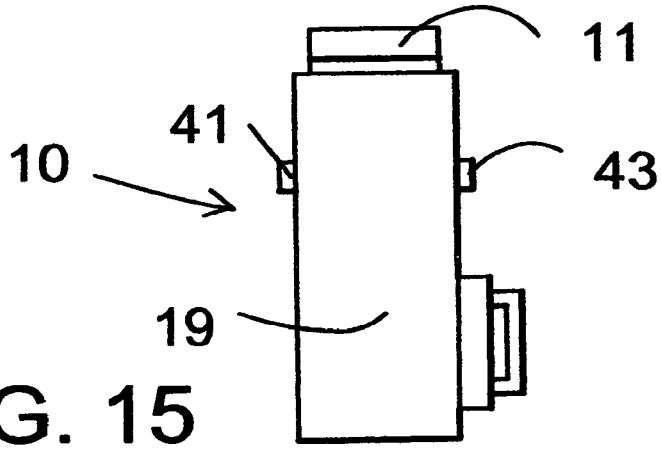
FIG. 15 is a right side elevation view of the ammunition magazine carrier as shown in FIG. 14.
Figure 16:
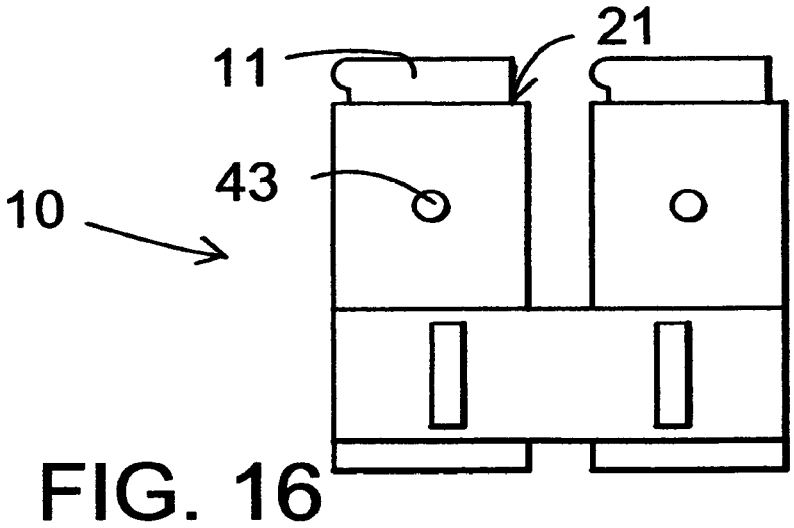
FIG. 16 is a rear elevation view of the magazine carrier as shown in FIG. 14.

In FIGS. 14-16, an additional feature of the embodiment is shown. Because, in the preferred embodiment, the pivotal fasteners 41 and 43 are snaps that allow the flap 22 to be disconnected from carrier frame 13, it is possible to remove the flap 22 from the carrier frame 13 and refasten it as desired. Using the magazine carrier with the flap removed could be appropriate in situations where protecting the contained magazines and/or appearance are less important than absolute unimpeded access to the magazines. The magazine carrier 10 is shown in an open position after the flap 22 has been removed by unsnapping the fasteners 41 and 43. With the flap 22 removed, the flap does not obstruct the removal of the magazine from the pocket 12. Optionally, a smooth unattached snap cover is provided to cover each of the portions of the fasteners 41 and 43 that are attached to the pocket walls, so that those portions are covered for appearance sake and to minimize any snagging. FIG. 14 is a front view, FIG. 15 is a right side view, and FIG. 16 is a rear view.

Figure 17:
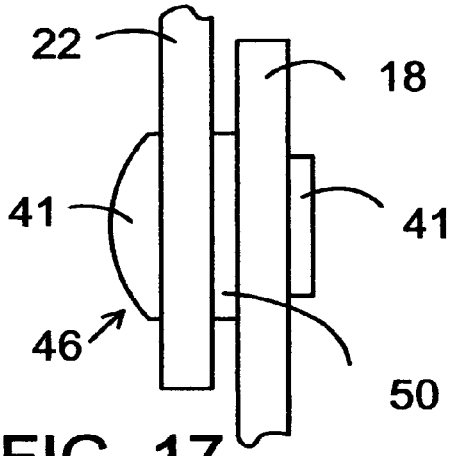
FIG. 17 is a right side elevation view of a pivotal fastener including a friction washer.

Normally, the material from which the magazine carrier is formed and the pressure between the wall of the pocket and the flap caused by the fasteners 41 and 43, creates sufficient friction between the pocket wall and the flap that the flap does not move or pivot unless it is intentionally forced to move by the user's hand. However, there are circumstances, for example, when the magazine carrier is formed of highly polished leather or when environmental conditions are particularly extreme, such as moving through heavy underbrush or dense jungle, that the friction between the pocket wall and the flap are not sufficient to keep the flap from moving and pivoting unintentionally. In such cases, the friction between the pocket wall and the flap can be increased or adjusted by various modifications. One approach, a friction enhancement system 46, is to simply place a washer 50, as shown in the FIG. 17, having high friction surfaces, between the front wall 18 and the flap 22 and concentrically around the fastener 41. The washer 50 could be fastened to the front wall 18 and cause increased friction against the flap 22 to minimize unintended pivoting of the flap. Conversely, the washer 50 could be fastened to the flap 22 and cause increased friction against the front wall to minimize unintended pivoting. A similar single-washer arrangement could be provided around fastener 43 and between the base wall 14 and the flap 22. The single-fastener arrangement could be used around fastener 41, or fastener 43, or around both.

Figure 18:
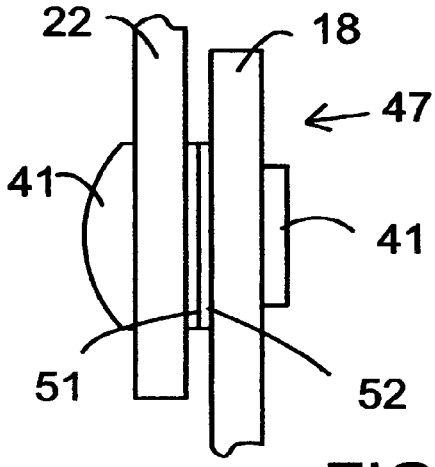
FIG. 18 is a right side elevation view of a pivotal fastener including two friction washers.

Another approach to a friction enhancement system 47, is to simply place two washer 51 and 52, as shown in the FIG. 18, having high friction surfaces, between the front wall 18 and the flap 22 and concentrically around the fastener 41. The washer 51 could be fastened to the flap 22 and the other washer 52 could be fastened to the front wall 18 to cause increased friction between washer 51 and washer 52 to minimize unintended pivoting of the flap. A similar double-washer arrangement could be provided around fastener 43 and between the base wall 14 and the flap 22. The double-fastener arrangement could be used around fastener 41, or fastener 43, or around both.

Figure 19:
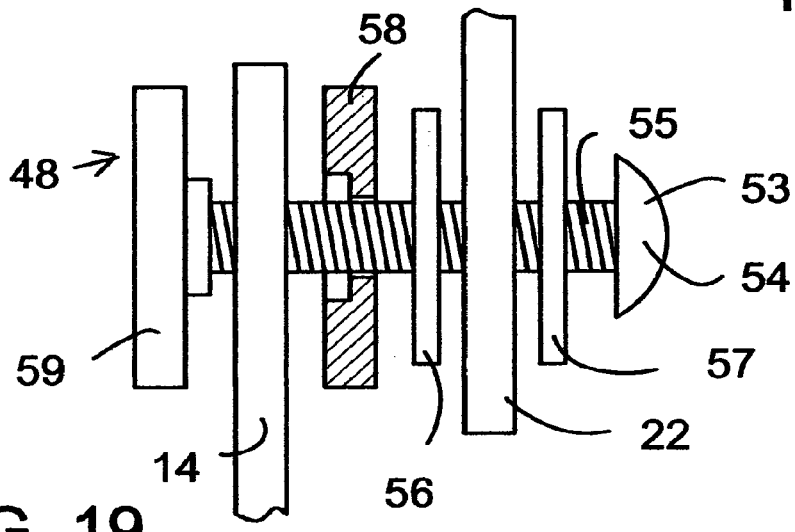
FIG. 19 is a right side elevation view of a pivotal fastener including a friction adjusting system.

Another method of increasing and adjusting the friction between the pocket wall and the flap in order to minimize unintended pivoting would be to provide an adjustable friction fastening element. FIG. 19 shows an adjustable fastening element 48 installed on the base wall 14 and the flap 22. The element has a threaded mounting bolt 53 with a head 54 and a threaded shaft 55. The shaft 55 is passed through the flap 22 with a friction washer 56 and 57 applied to each side of the flap 22. An outer plate 58 is then threaded on the threaded shaft 55 and shaft 55 is passed through the base wall 14 and then threaded into an inner plate 59. By turning the mounting bolt 53 in the inner plate 59, the friction between the washers 56 and 57 and the flap 22 and therefore between the flap 22 in the base wall can be adjusted to minimize unintended pivoting of the flap 22.

Figure 20:
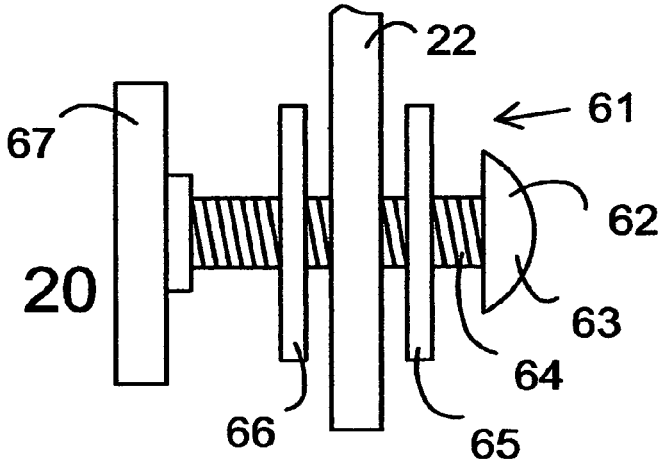
FIG. 20 is a right side elevation view of a pivotal fastener including a second friction adjusting system.

Still another method of increasing and adjusting the friction between the pocket wall and the flap in order to minimize unintended pivoting would be to provide a simpler adjustable friction fastening element 61. FIG. 20 shows an adjustable fastening element 61 installed on the flap 22. The element 61 has a threaded mounting bolt 62 with a head 63 and a threaded shaft 64. The shaft 64 is passed through the flap 22 with a friction washer 65 and 66 applied to each side of the flap 22. The threaded shaft 64 is threaded into an inner plate 67. By turning the mounting bolt 62 in the inner plate 67, the friction between the washers 65 and 66 and the flap 22 and therefore between the flap 22 in the base wall can be adjusted to minimize unintended pivoting of the flap 22.

The advantage of this pivotable flap design is realized during combat situations where a firearm must be reloaded under intensely stressful situations. Typically, the firing hand and the non-firing hand must each perform separate and independent actions to reload a firearm. The firing hand must release the expended magazine from the firearm, which is typically accomplished by a magazine release lever or button mounted on the handgun, while continuing to hold the firearm in the fire-ready position. Concurrently, the non-firing hand must independently reach for, access, and acquire the seated magazine 11. In the present invention, the operation of the pivotal flap 22 from the closed position to the open position in a single motion provides immediate access and acquisition of the spare magazine 11 without unnecessarily cumbersome additional steps. Moreover, absence of a flap over the pocket opening prevents the possibility of the top flap snagging on the magazine as it is being withdrawn from the pocket.

While reference to "top" or "upper" e.g. top end 15, and "bottom" or "lower", e.g. bottom end 16, generally indicates a vertical orientation of the magazine carrier 10 aligning with the upright stance of a user's person, the magazine carrier 10 is not limited only to such. Rather, the magazine carrier 10 can be oriented in a manner which allows convenient, and easy access to the ammunition magazine located therein.

While it will be apparent that the illustrated embodiments of the invention herein disclosed are calculated adequately to fulfill the object and advantages primarily stated, it is to be understood that the invention is susceptible to variation, modification, and change within the spirit and scope of the subjoined claims. It is obvious that minor changes may be made in the form and construction of the invention without departing from the material spirit thereof. It is not, however, desired to confine the invention to the exact form herein shown and described, but it is desired to include all such as properly come within the scope claimed.

I claim:

1. A magazine carrier securable on a user's person for carrying at least one ammunition magazine, said magazine carrier comprising:

a carrier frame having a pocket adapted to carry a magazine, said pocket including four side walls, a bottom wall, and a top opening defined by an uppermost periphery of said four side walls, wherein said magazine is inserted into and removed from the pocket through the top opening;

a cover flap having a first end attached to one of said side walls via a first fastener and a second end attached to an opposite one of said side walls via a second fastener;

and means for securing the carrier frame on a user's person;

wherein said cover flap, in a closed position, extends over and above said top opening in order to prevent removal of the magazine from the pocket and, in an open position, is pivoted laterally toward a side of the carrier frame and away from the top opening in order to allow removal of the magazine from the pocket;

wherein said first and second fasteners each include a threaded fastener and at least one friction washer, such that the friction washers enhance friction between the carrier frame and the cover flap in order to minimize unintended pivoting of the cover flap from the closed position to the open position;

and wherein a user need only apply a lateral force upon the cover flap in order to move the cover flap from the closed position to the open position.

2. The magazine carrier as recited in claim 1, wherein the first and second fasteners allow the flap to pivot about a common axis.

3. The magazine carrier as recited in claim 1, wherein the means for securing the carrier frame on a user's person comprises at least one belt loop connected to one of the side walls that has the cover flap pivotally attached thereto.

4. The magazine carrier as recited in claim 1, wherein the at least one friction washer comprises two friction washers.

5. The magazine carrier as recited in claim 1, further comprising an additional carrier frame and cover flap in order to allow a user to carry more than one ammunition magazine.

* * * * *